US005569084A

United States Patent [19]

Nicastro et al.

[11] Patent Number: 5,569,084

[45] Date of Patent: Oct. 29, 1996

[54] FRACTIONAL BRANCHING REEL-TYPE SLOT MACHINE

[75] Inventors: Neil D. Nicastro; Timothy J. Durham, both of Chicago, Ill.

[73] Assignee: WMS Gaming Inc., Chicago, Ill.

[21] Appl. No.: 447,988

[22] Filed: May 23, 1995

Related U.S. Application Data

[63] Continuation-in-part of Ser. No. 259,786, Jun. 14, 1994, Pat. No. 5,423,541.

[51] Int. Cl.[6] ..... G07F 17/34

[52] U.S. Cl. ..... 463/20; 463/21; 273/143 R

[58] Field of Search ..... 273/143 R; 463/20, 463/21

[56] References Cited

U.S. PATENT DOCUMENTS 5,102,134 4/1992 Smyth ..... 463/21

5,169,147 12/1992 Hamano ..... 463/21

FOREIGN PATENT DOCUMENTS 0338743 10/1989 European Pat. Off. .

0391667 10/1990 European Pat. Off. .

*Primary Examiner*—Benjamin H. Layno

*Attorney, Agent, or Firm*—Rockey, Rifkin and Ryther

[57] ABSTRACT

A method of implementing desired odds for a reel-type slot machine is disclosed. All of the possible reel stop combinations are assigned to unique terminal nodes in one or more fractional branching trees stored in a ROM. The tree(s) comprises a main tier, a plurality of lower tiers and a plurality of terminal nodes. Each of the tiers has a number of entries which lead either to a lower tier or to a terminal node. A random number generator is used to select entries on each tier until a terminal node is selected. The reel stop combination or a particular symbol assigned to the terminal node is then displayed on the pay line and an award is paid based on a pay table.

8 Claims, 8 Drawing Sheets

| | SYMBOL SETS | PAY | WAYS TO DISPLAY | DESIRED ODDS |
|---|---|---|---|---|
| A | 7 7 7 | 200 | 12 | .00028 |
| B | ≡ ≡ ≡ | 100 | 12 | .00180 |
| C | = = = | 40 | 16 | .00170 |
| D | — — — | 10 | 48 | .01200 |
| E | ANY BAR | 5 | 572 | .07500 |
| F | 3 BLANKS | 2 | 343 | .07000 |
| G | LOSER | 0 | 4,829 | .83922 |
| | | | 5,832 | 1.00000 |

FIG. 7

| | | | | | |
|---|---|---|---|---|---|
| 1 | 7 | 1 | 7 | 1 | 7 |
| 2 | — — | 2 | — — | 2 | — — |
| 3 | 1 BAR | 3 | 1 BAR | 3 | 1 BAR |
| 4 | — — | 4 | — — | 4 | — — |
| 5 | 3 BAR | 5 | 3 BAR | 5 | 3 BAR |
| 6 | — — | 6 | — — | 6 | — — |
| 7 | 2 BAR | 7 | 2 BAR | 7 | 2 BAR |
| 8 | — — | 8 | — — | 8 | — — |
| 9 | 1 BAR | 9 | 1 BAR | 9 | 1 BAR |
| 10 | — — | 10 | — — | 10 | — — |
| 11 | 3 BAR | 11 | 7 | 11 | 3 BAR |
| 12 | — — | 12 | — — | 12 | — — |
| 13 | 2 BAR | 13 | 2 BAR | 13 | 2 BAR |
| 14 | — — | 14 | — — | 14 | — — |
| 15 | 1 BAR | 15 | 1 BAR | 15 | 1 BAR |
| 16 | — — | 16 | — — | 16 | — — |
| 17 | 1 BAR | 17 | 1 BAR | 17 | 1 BAR |
| 18 | — — | 18 | — — | 18 | — — |

FIG. 8

| | SYMBOL SETS | PAY | WAYS TO DISPLAY | DESIRED ODDS |
|---|---|---|---|---|
| A | 7 7 7 | 200 | 2 | .000260 |
| B | = = = | 100 | 4 | .001818 |
| C | = = = | 40 | 8 | .001777 |
| D | — — — | 10 | 64 | .012000 |
| E | ANY BAR | 5 | 372 | .075000 |
| F | 3 BLANKS | 2 | 729 | .070000 |
| G | LOSER | 0 | 4,653 | .839144 |
| | | | 5,832 | 1.00000 |

| SYMBOL SETS | PAY | WAYS TO DISPLAY | DESIRED ODDS |
|---|---|---|---|
| 3 BAR 3 BAR 3 BAR | 50 | 1 | .000244 |
| 2 BAR 2 BAR 2 BAR | 20 | 1 | .001953 |
| 1 BAR 1 BAR 1 BAR | 10 | 1 | .015625 |
| ANY 3 BARS | 5 | 24 | .065918 |
| 3 BLANKS | 2 | 8 | .177979 |
| LOSER | 0 | 87 | .738281 |
| | | 125 | 1.000000 |

FRACTIONAL BRANCHING REEL-TYPE SLOT MACHINE

CROSS-REFERENCE TO RELATED APPLICATIONS

This application is a continuation-in-part of U.S. patent application Ser. No. 08/259,786, filed Jun. 14, 1994 now U.S. Pat. No. 5,423,541.

BACKGROUND AND SUMMARY OF THE INVENTION

The present invention generally relates to gaming apparatus and, more particularly, to electronic reel-type slot machines having a plurality of reels rotatable about a common axis. In a typical reel-type slot machine, a payoff is made to a player when a winning set of symbols is displayed on the pay line(s) of the machine. To start play, a button is pushed or a handle is pulled to initiate rotation of the reels.

In one type of design, the angular positions of the reels, after they have been stopped, is detected and the appropriate payoff amount, if any, is calculated and paid to the player. Another approach in modern machines uses a random number generator to select the symbols to be displayed on the pay line(s). The payoff is then determined based on a pay table which contains payoff amounts for the various winning symbol combinations. Payoff amounts provided by either approach are limited because there is a fixed limit on the probability of obtaining the maximum payoff, which is the reciprocal of the number of reel stop positions per reel raised to the power of the number of reels.

Accordingly, it is desirable for manufacturers of reel-type slot machines to provide new ways to increase reel-type slot machine payoff values while maintaining adequate game revenue for the operator. As the payoff amounts increase, player interest in the game is fostered which leads to maximized game revenue.

One method of increasing payoff values in a prior art electronic slot machine design is to employ a "virtual reel". According to this method, a plurality of numbers are assigned to most of the physical reel stop positions and at least one number is assigned to every physical reel stop position. In this way, the chances of winning the larger payoffs can be decreased by assigning these stop combinations to fewer numbers.

The present invention provides an alternative method for increasing payoff levels in electronic reel-type slot machines. The odds of obtaining a particular winning symbol set can be "dialed in" by assigning each possible reel stop combination to a unique terminal node (position) in a random number fractional branching tree. The tree comprises a main tier, a plurality of lower tiers and a plurality of terminal nodes. Each of the tiers has a number of entries which lead either to a lower tier or to a terminal node.

During game play, one of the entries on the main tier is randomly selected by the game microprocessor. If the randomly selected entry leads to a lower tier, then one of the entries on that tier is randomly selected. This selection process continues for each successive tier until a terminal node is selected. One reel stop combination is assigned to each terminal node. The combination assigned to the selected terminal node is then displayed on the pay line(s) of the slot machine. A payoff is made to the player if the combination displayed corresponds to a winning symbol combination in a posted pay table.

In an alternate embodiment of the invention, one fractional branching tree is utilized for each reel strip, each tree having a main tier, a plurality of lower tiers and a plurality of terminal nodes. All of the symbols for each reel are assigned to unique terminal nodes in the fractional branching tree corresponding thereto. To display a reel stop combination on the pay line(s) of the slot machine, the selection process described above is used to randomly select a terminal node and the symbol assigned thereto for each of the reels. The selected combination is displayed and a payoff is made if it corresponds to a winning symbol combination in a posted pay table.

BRIEF DESCRIPTION OF THE DRAWINGS

FIG. 7 illustrates a second example of three reel "strips" containing symbols positioned at the stop positions.

FIG. 8 is a table showing payoffs and desired odds of obtaining a winning symbol set for the reel strips of FIG. 7.

DETAILED DESCRIPTION OF THE PREFERRED EMBODIMENT

Figure 1:
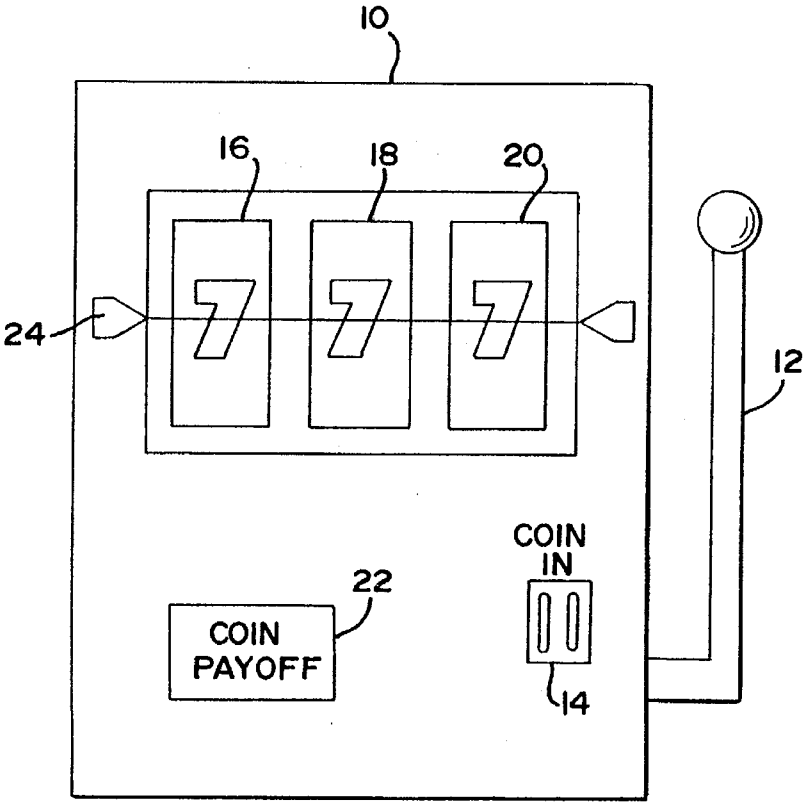
FIG. 1 shows a typical electronic reel-type slot machine which may incorporate the present invention.

Referring to FIG. 1, an electronic reel-type slot machine 10 is illustrated. Slot machine 10 includes a handle 12, a coin slot 14, payout trough 22 and reels, each having a plurality of stop positions thereon. Each reel includes a system of symbols which are used to display an outcome of a game which is played on slot machine 10. In the illustrated embodiment, slot machine 10 includes three slot reels 16, 18 and 20, each of which has eighteen stop positions each of which corresponds to a symbol. The symbols form combinations which correspond to a pay table displayed to the player.

It must be noted that slot machine 10 can incorporate any number of reels and that the reels can include any reasonable number of stop positions. Any system of symbols can be utilized a long as there is one symbol, which may include a "blank" symbol, corresponding to each stop position on each reel. When a coin is inserted, the game start button and/or handle is enabled. By pushing the start button or pulling the handle, the player causes the microprocessor control system to spin the reels in an attempt to win money if a winning set of symbols is chosen and displayed on the pay line 24.

Figure 2:
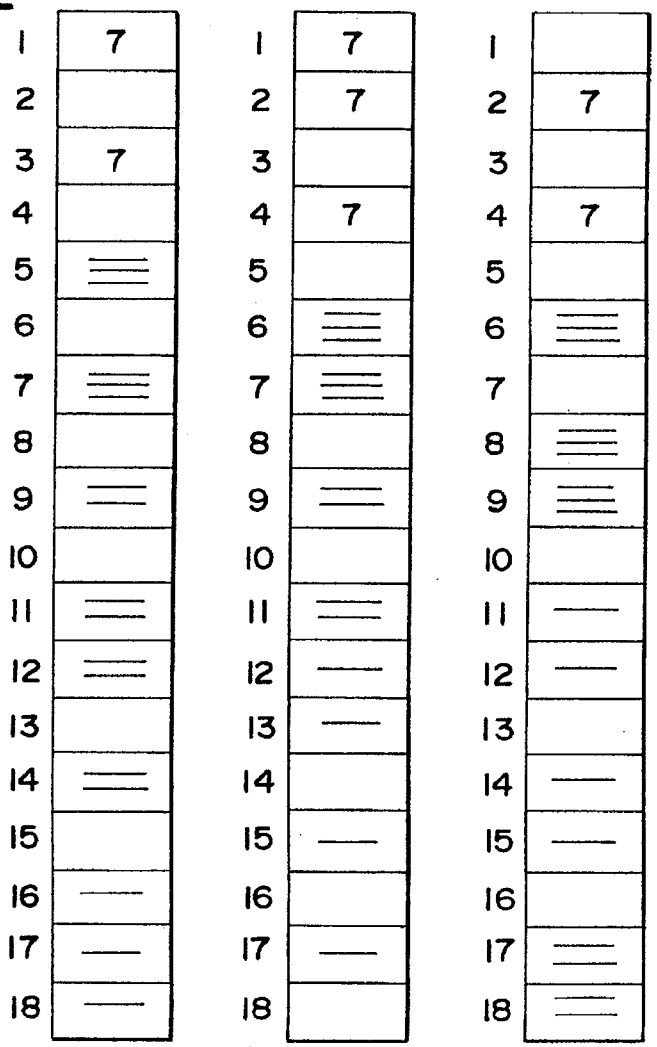
FIG. 2 illustrates one example of three reel "strips" containing symbols positioned at the stop positions.

FIG. 2 illustrates an example of three reel "strips" which can be attached to reels 16–20. Each of the reel strips contain a system of symbols as discussed above and, in this example, has eighteen discrete physical stop positions at which one of the symbols is displayed. It should be noted that duplicate symbols can be employed on each reel. In the illustrated embodiment, reel one displays two "7s," two triple bars, four double bars, three single bars and seven blanks; reel two displays three "7s," two triple bars, two double bars, four single bars and seven blanks; and reel three displays two "7s," three triple bars two double bars, four single bars and seven blanks.

Figures 3, 4:
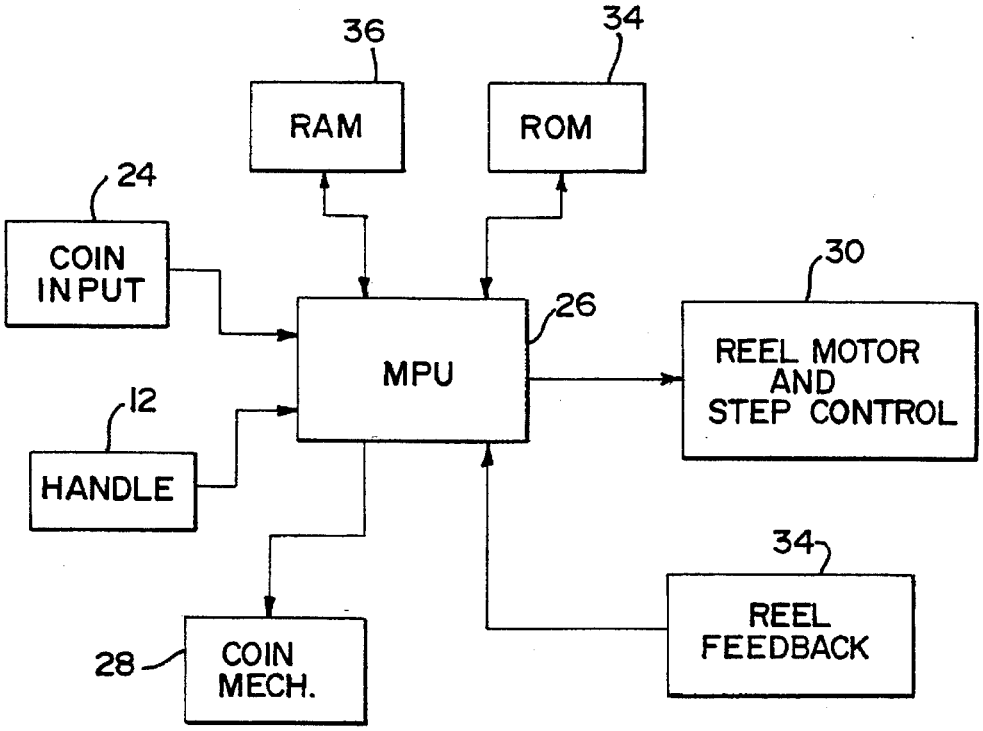
FIG. 3 is a block diagram of a control system for the present invention.
FIG. 4 is a table showing the payoffs and desired odds of obtaining a winning symbol set for the reel strips of FIG. 2.

FIG. 3 is a block diagram of a control system suitable for practicing the present invention. Coin detector 24 sends a signal to microprocessor 26 when a coin is inserted into coin slot 14. The microprocessor then randomly selects the symbol set to be displayed on the pay line. If a player wins, then microprocessor 26 signals the conventional coin mechanism 28 to dispense a payoff to the player via coin payout trough 22.

Reel motor and step controller 30 rotates the reels 16–20 in response to a signal from microprocessor 26. The signal is generated after a coin input and player operation of the handle 12 or the start button. Controller 30 stops the reels at positions determined by the microprocessor such that the reels display three symbols on the pay line 22.

During the reel spin, microprocessor 26 randomly selects one of the reel stop combinations for display on the pay line. To ensure that the selected reel stop combination is displayed, detector 32 provides feedback signals to microprocessor 26 which are representative of the rotational position of each reel relative to pay line 22. Feedback of this type is utilized in accordance with well known techniques in this art.

FIG. 4 shows a symbol table which lists the winning sets of symbols A–F and the losing sets of symbols G that can be displayed on pay line 22 for the reel strips of FIG. 2. Also listed in FIG. 4 are the number of physical reel stop combinations and the desired win percentages which correspond to the symbol sets A–G. The odds of obtaining a particular symbol set can be controlled by assigning each possible reel stop combination to a unique terminal node in a random number branching tree. The location in the tree affects the likelihood of the symbol combination being selected. By way of example, the desired odds listed in FIG. 4 are implemented by the fractional branching tree 38 of FIG. 5.

Branching tree 38 includes a plurality of tiers 40–54 having level values of 0.10 to 0.00001 and a plurality of entries which lead either to lower tiers or to terminal nodes. The tree is a conceptual device which is used to explain the method of the invention. In actuality, each reel stop combination is stored in a ROM memory look-up table corresponding to its terminal node location in tree 38. Each one of the possible reel stop combinations is assigned only once in the tree structure and thus to only one memory location in ROM 34.

The odds for each of the symbol sets A–G, as listed in FIG. 4, may be calculated from the tree as follows. For each tier in tree 38, the number of terminal nodes associated with a particular symbol set is multiplied by that tier's level value. These numbers are then summed to compute the odds.

Figure 5:
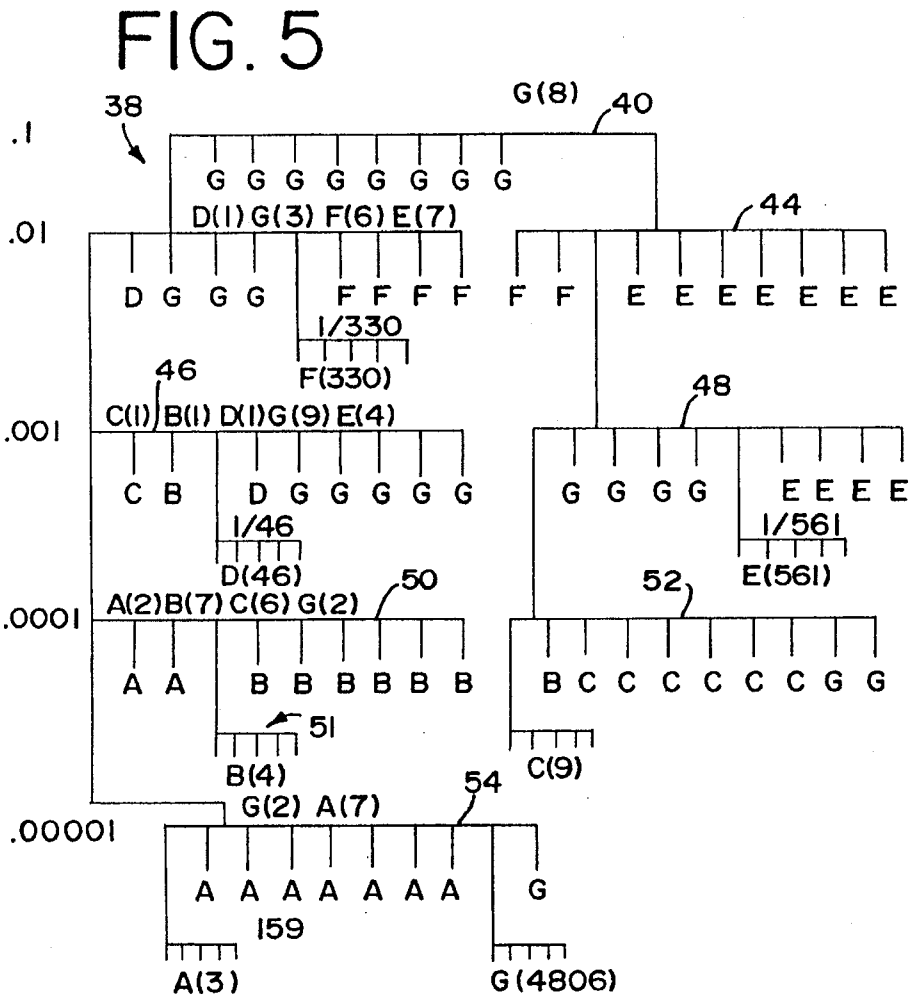
FIG. 5 illustrates a first embodiment of a fractional branching tier system of the present invention.

For example, the desired odds of obtaining three triple bars, symbol set B, is 0.00180. Referring to FIG. 5, one "B" is placed at tier 46 and eight "B" are placed at tiers 50 and 52. Thus, the desired odds of obtaining three triple bars is (1 * 0.001) +(7 * 0.0001) +(1 * .0001) =0.0018.

The third term in the calculation requires explanation. It relates to the sub-tier 51 dropping from tier 50. Note that FIG. 4 requires 12 unique ways to display three triple bars. To include all of these combinations and still obtain the desired odds, it is necessary to lower one of the B combinations to a sub-tier in which all of the nodes are set B. The remaining number of nodes in the sub-tier is equal to the number of combinations not used in setting the odds. Thus, sub-tier 51 has four nodes set to B.

If the entry leading to the sub-tier 51 is selected, the probability of obtaining a B combination is 1.0, the only question being which B combination. Microprocessor 26 randomly selects one of the nodes of the sub-tier to determine which reel stop combination is displayed on the pay line. A similar exercise is employed to implement the probabilities for each of the other symbol groups A and C–G.

It should be noted that the implementations of the FIG. 5 embodiment is accomplished principally using decimal tiers. That is, only ten entries per tier. The use of sub-tiers of varying size, each sub-tier having a probability of 1 for the assigned symbol set, permits the use of all possible reel stop combinations so that no combinations of stop positions need be used or stored in memory more than once. Thus, for example, to display three sevens in twelve unique ways without changing the odds, a sub-tier 159, having three terminal nodes, one for each additional reel stop combination for displaying three sevens, is provided in place of an "A" combination on tier 54.

Note that the desired odds could be implemented without the use of sub-tiers. In that case, however, not all of the possible combinations of the symbol sets would be displayed. As it is desirable to be able to display each possible combination for a symbol set, the use of sub-tiers is preferred.

Figure 6:
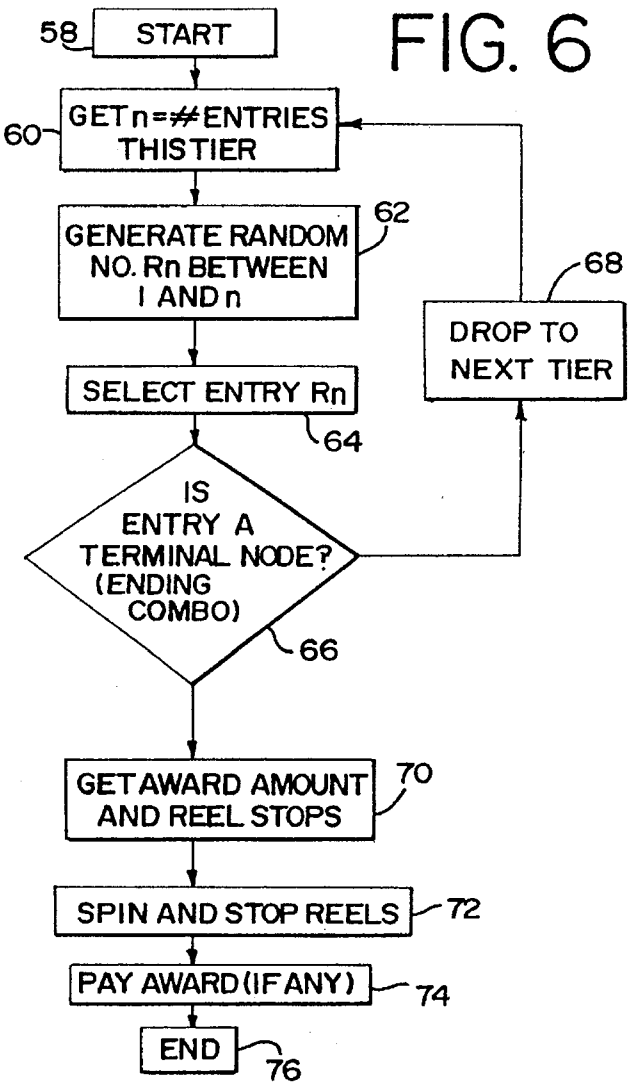
FIG. 6 is a computer flow diagram illustrating a preferred embodiment of the invention.

Referring to FIG. 6, a computer flow diagram is shown which illustrates the steps executed by microprocessor 26 to select a reel stop combination to be displayed on the pay line. The steps illustrated in FIG. 6 are stored as a computer program in read only memory 34 which is executed by microprocessor 26 when the game is played. Current game data is stored in a random access memory (RAM) 36. FIG. 6 is a flow diagram which illustrates the essential program steps of the invention permitting it to be implemented on any type of computer system desired.

The program begins at start step 38. The random number generator function of microprocessor 26 is used to randomly select one of the entries on the main tier 40 of the branching tree (steps 58–64). With reference to the branching tree of FIG. 5, microprocessor 26 randomly selects an integer from 1 to 10 (or 0 to 9) which is used to select one of the ten entries on the main tier 40. If the selected entry is not a terminal node, step 66, then the program drops to the next lower tier (step 68) and repeats steps 58–64 until a terminal node is selected.

If the selected entry is a terminal node, the unique reel stop combination assigned thereto is displayed on the pay line and the appropriate payoff, if any, is determined, step 70. The payoff amounts are stored in a look-up table in ROM 34 for each of the winning symbols sets A–F (FIG. 4). The reels which spin while the selection process is implemented (or spin after selection, as desired) are stopped to display the selected reel stop combination and the appropriate award is paid (steps 72–76).

FIG. 7 illustrates a second example of three reel "strips" which can be attached to reels 16–20. The winning sets of symbols A–F and the losing sets of symbols G that can be displayed on pay line 22, the corresponding payoffs and the desired win odds are listed in the table shown in FIG. 8.

Figure 9:
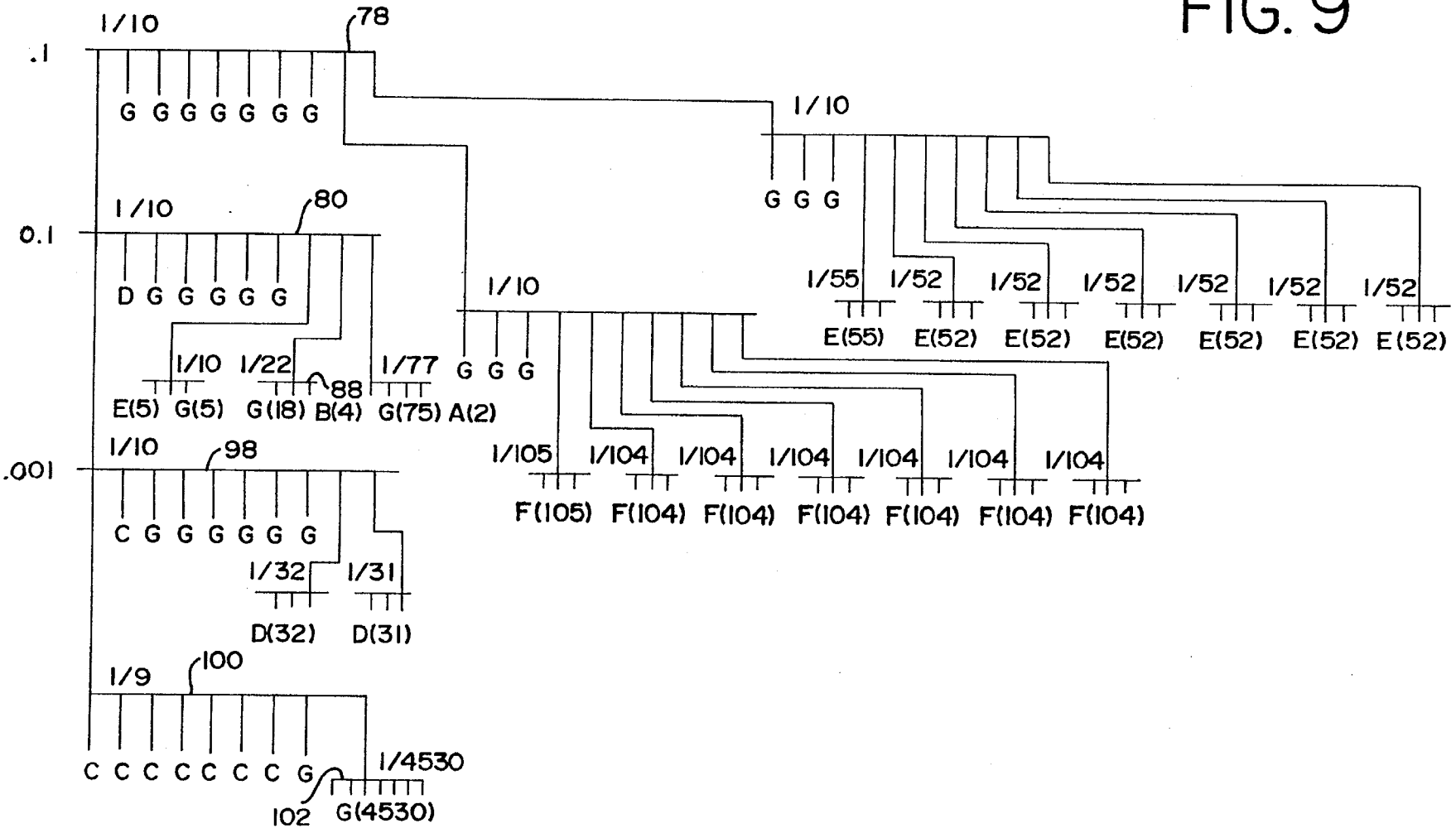
FIG. 9 illustrates a preferred embodiment of a fractional branching tier system of the present invention.

FIG. 9 illustrates a second embodiment of a fractional branching tree which implements the desired odds for the example of FIGS. 7 and 8. For clarity, the number of entries on each tier leading to terminal nodes or to lower tiers is labeled in the form 1/X (1 out of X) where X is the number of entries for the tier. The number of reel stop combinations for a given symbol set located on a tier is labeled directly below the tier in parenthesis, if numerous. The tiers have different values of X as necessary to implement each possible reel stop combination for a given symbol set at the desired odds.

The use of variable length tiers, particularly for the lower tiers, allows the odds to be precisely dialed in with a minimum number of iterations of steps 60–66 (FIG. 6). The desired odds of obtaining a particular set of symbols requires only a minimum number of drops to successive tiers from the main tier. For example, the desired odds of obtaining three triple bars (Group B in FIG. 8) can be implemented by repeating steps 60–66 three times. Thus, the desired odds (0.001818) is implemented by dropping from tier 78 to sub-tier 88 via tier 80.

More specifically, if the RNG function selects the corresponding entry of tier 78 (the 0.1 level), a drop is made to tier 80 (the 0.01 level). Another iteration of the RNG cycle could result in a further drop to sub-tier 88. Sub-tier 88 has 22 terminal nodes of which four represent the four possible reel stop combinations for displaying three triple bars. Thus, the designation B(4) is shown at sub-tier 88. The odds of selecting any one of the B group terminal nodes equals $1/10*1/10*4/22=0.001818$.

Similarly, the desired odds for obtaining three double bars, group C, is implemented by dropping to sub-tier 100 via tiers 78, 80 and 98. The desired odds of 0.0018 are obtained by assigning one of the eight possible reel stop combinations to tier 98 and the remaining seven combinations to sub-tier 100. Thus, the desired odds equal $(1/10*1/10*1/10)+(1/10*1/10 1/10*7/8)=0.001+0.000777=0.001777$.

Calculations similar to those illustrated above can be used to implement the desired odds for the remaining sets of symbols resulting in the tree structure of FIG. 9. After all of the odds for the winning sets of symbols are implemented, the remaining terminal nodes in the branching tree are "filled out" with losing reel stop combinations. Thus, the desired odds of obtaining a losing symbol set, Group G in FIG. 8, equals $(1/10*7)+(1/10*1/10 5)+(1/10*1/10*5/10)+(1/10*1/10*18/22)+(1/10*1/10*75/77)+(1/10*1/10*3)+1/10*1/10*3)+(1/10*1/10*1/10*6)+(1/10*1/10*2/9)=0.839144$.

Figures 10, 11:
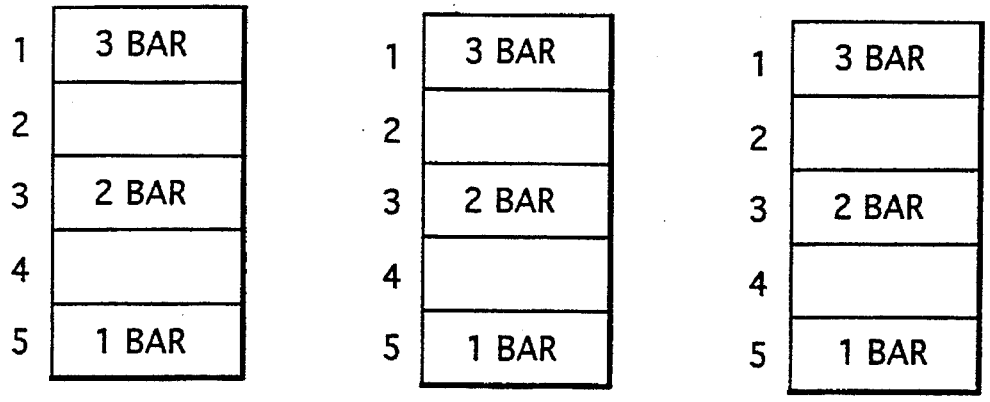
FIG. 10 illustrates one example of three reel "strips" containing symbols positioned at the stop positions for an alternate embodiment of the invention.
FIG. 11 is a table showing the payoffs and the odds of obtaining a winning symbol set for the reel strips of FIG. 10.

FIG. 10 illustrates an alternate embodiment of the invention and three exemplary reel "strips" which can be attached to reel 16–20 shown in FIG. 1. Each of the reel strips contains a system of symbols and, in this example, there are five discrete physical stop positions at which one of the symbols is displayed. The symbols for each reel are assigned to unique terminal nodes in a fractional branching tree corresponding to each reel. In the illustrated embodiment, each reel displays one triple bar, one double bar, one single bar and two blank symbols.

FIG. 11 is a table which lists the winning symbol sets that can be displayed on the payline 22 (FIG. 1) for the reel strips of FIG. 10. Also listed in FIG. 11 are the number of physical reel stop combinations and the win percentages which correspond to the winning symbol sets. The odds of obtaining a particular symbol set are determined by assigning each symbol to a terminal node in a random number branching tree for each of the reels. The location in the tree determines the probability of the symbol being selected.

The probability of selecting a combination of three symbols is calculated by multiplying the odds for each reel. By way of example, the odds listed in FIG. 11 are implemented by three iterations through the fractional branching tree 150 shown in FIG. 12. It will be appreciated, however, that only one tree is necessary for the reels in the illustrated embodiment because each reel contains the same system of symbols. If multiple systems of symbols are used, then a separate fractional branching tree would be utilized for each of the different system of symbols.

Figure 12:
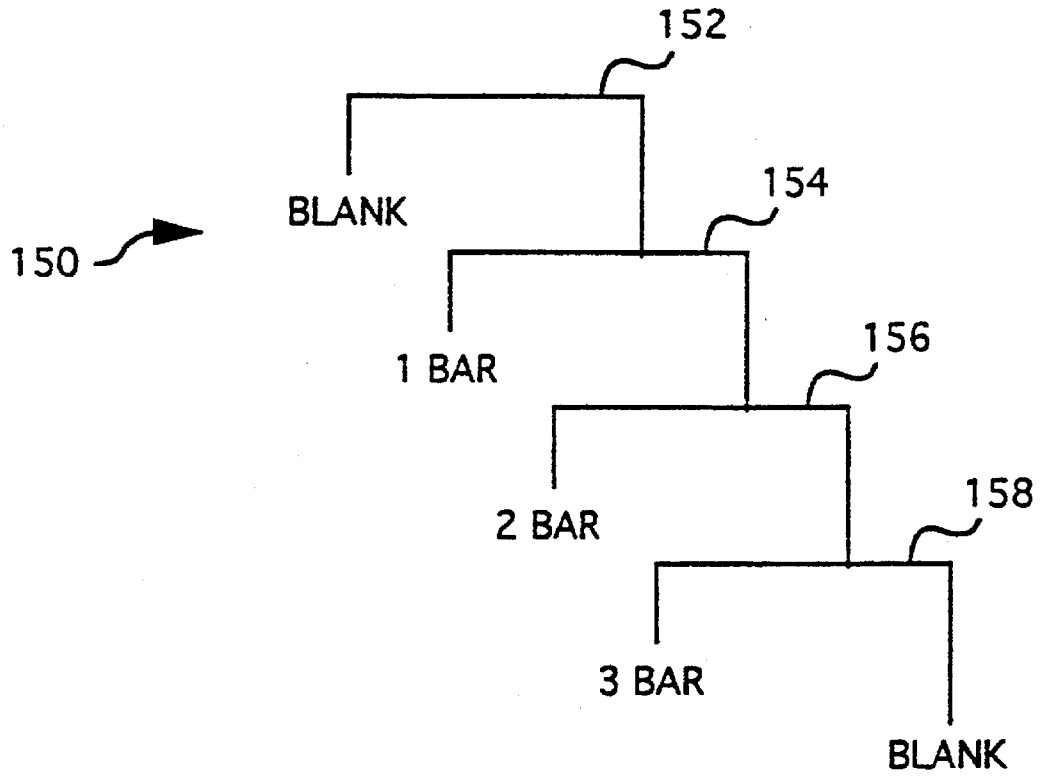
FIG. 12 illustrates an alternate embodiment of a fractional branching tier system of the present invention.

Referring to FIG. 12, fractional branching tree 150 includes a plurality of tiers 152, 154, 156 and 158 each having entries which lead either to lower tiers or to a terminal node. As with the first embodiment, it should be emphasized that each of the possible symbols is assigned only once in the tree structure and, therefore, to only one memory location in ROM 34 (FIG. 3).

The probability for selecting each of the winning symbol sets, as listed in FIG. 11, may be calculated from three iterations through the tree 150 (or through three separate trees if separate symbol sets are used) as follows. For each tier in tree 150, the number of terminal nodes associated with a particular symbol is divided by the number of terminal nodes in that tier. If the tree contains the same symbol at different levels, then this computation is repeated for each symbol, the results being summed to arrive at the odds of selecting that symbol for a particular reel. This process is repeated three times until a symbol is selected for each of the three reel strips shown in FIG. 10. Finally, the numbers obtained from each iteration through the random number tree 150 are multiplied to compute the probability of obtaining a particular combination of symbols.

For example, the odds of obtaining three triple bars, is 0.000244. Referring to FIG. 12, one triple bar is placed at tier 158 and, therefore, the odds of obtaining a triple bar on one reel is $0.5\times0.5\times0.5\times0.5=0.0625$. Thus, the odds of obtaining a triple bar on each reel equals $(0.0625\times0.0625\times0.0625=0.000244)$. The odds of obtaining the blank symbol on one reel is $(0.5\times0.5\times0.5\times0.5)+0.5=0.5625$. Therefore, the odds of obtaining a winning combination of three blank symbols is $(0.5625\times0.5625\times0.5625=0.177979)$.

Figure 13:
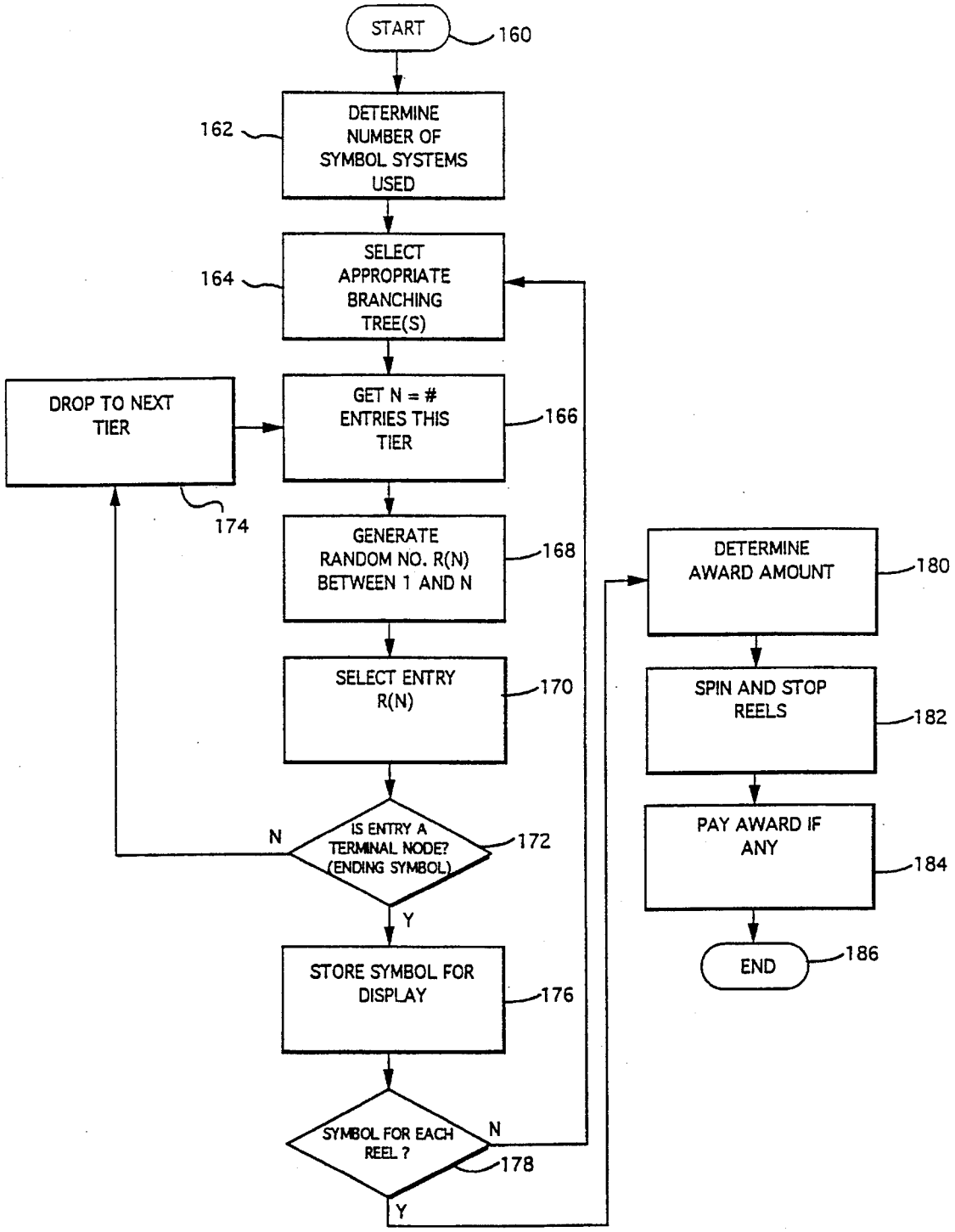
FIG. 13 is a computer flow diagram illustrating the alternate embodiment of the invention presented in FIGS. 10–12.

FIG. 13 is a computer flow diagram illustrating the operation of the alternate embodiment of the invention shown in FIGS. 10–12. As with the first embodiment, the random number generator function of microprocessor 26 is used to randomly select entries on the main tier of the branching tree corresponding to the first reel until a terminal node is reached (steps 160–174). The unique symbol assigned thereto is stored for display, step 176. Steps 160–174 are repeated for each of the reels of the slot machine, step 178, using the same or a different branching tree depending on the similarity of the reel strips. After symbols have been selected for all reels, the reels are spun and stopped to display that combination on the pay line and the appropriate payoff, if any, is determined and made, steps 18–186.

While the invention has been illustrated and described in detail in the drawings and foregoing description, the same is to be considered as illustrative and not restrictive in character. Thus, for example, larger reel strips can be employed and accommodated simply by expanding the tree structure.

What is claimed is:

1. A method of setting the probability of selection of symbols to be displayed on the pay line(s) of a multi-reel slot machine comprising the steps of:

(a) specifying the symbols for each reel;

(b) providing a symbol look-up table in a memory device for each reel, each look-up table being arranged in a tree branch structure containing tiers of descending probability, each tier having terminal nodes at which individual symbols may be stored and descending nodes which lead to lower tiers, each lower tier having a decreasing probability of occurrence; and (c) storing the symbols for each reel in the corresponding look-up table at terminal node locations within the tree branch structure corresponding to a desired payoff probability.

2. The method of claim 1 further comprising the step of (d) randomly selecting numbers corresponding to the terminal and descending nodes for each tree to randomly select the symbols to be displayed on the pay line(s) of said slot machine.

3. The method of claim 2 wherein step (d) includes the sub-steps of:

(i) randomly selecting a node in the first tier of said tree branch structure;

(ii) determining if the selected node is a terminal node or a descending node;

(iii) in the event a descending node is determined, dropping to the referenced lower tier in said tree and repeating steps (i) and (ii) for such lower tier until a terminal node is determined;

(iv) storing the symbol assigned to said selected terminal node for display; and (v) repeating steps (i) through (iv) for each of the reels in said slot machine.

4. The method of claim 1 wherein step (a) includes the sub-steps of selecting the symbols and frequency of each symbol for each reel.

5. The method of claim 3 wherein step (i) includes the sub-steps of determining the number of nodes, N, in the tier and randomly selecting a number from 1 to N to select a node.

6. The method of claim 1 wherein each reel contains a different set of symbols and a separate look-up table for each reel is stored in said memory device.

7. A method of selecting a combination of symbols to be displayed on the payline(s) of a reel-type slot machine comprising the steps of:

(a) for each reel, assigning all possible symbols to terminal nodes in a fractional branching tree look-up table contained in a memory device, said table having a main tier and a plurality of lower tiers, each tier having a plurality of terminal nodes and, except for the lowest tiers, a plurality of descending nodes, said terminal nodes containing said symbols and said descending nodes leading to successively lower tiers in said table;

(b) randomly selecting one of the nodes in the main tier and determining if it is a terminal node or a descending node;

(c) if a descending node is determined, repeating step (b), as necessary, for each successively lower tier until a terminal node is selected;

(d) storing the symbol assigned to a selected terminal node for display; and (e) repeating steps (b) through (d) for each of the reels to randomly select a combination of symbols.

8. The method of claim 7 wherein said step (b) includes the sub-steps of determining the number of nodes, N, in the tier and randomly selecting an integer from one to N to select a node.

* * * * *